US005174878A

United States Patent [19]

Wüllenweber et al.

[11] Patent Number: 5,174,878

[45] Date of Patent: Dec. 29, 1992

[54] ELECTROLYZER

[75] Inventors: Heinz Wüllenweber, Frankfurt am Main, Fed. Rep. of Germany; Jürgen Borchardt, Troistorrents, Switzerland

[73] Assignee: Metallgesellschaft Aktiengesellschaft, Frankfurt, Fed. Rep. of Germany

[21] Appl. No.: 696,665

[22] Filed: May 7, 1991

[30] Foreign Application Priority Data

May 9, 1990 [DE] Fed. Rep. of Germany ..... 4014778

[51] Int. Cl.[5] ..... C25B 9/00; C25B 11/03; C25B 13/04

[52] U.S. Cl. ..... 204/254; 204/279; 204/282; 204/283; 204/290 R; 204/295

[58] Field of Search ..... 204/252-258, 204/263-266, 282-283, 279, 295

[56] References Cited

U.S. PATENT DOCUMENTS

| | | | |
|---|---|---|---|
| 4,029,565 | 6/1977 | Bender et al. | 204/256 |
| 4,309,264 | 1/1982 | Bender et al. | 204/256 |
| 4,698,143 | 10/1987 | Morris et al. | 204/254 X |
| 5,013,418 | 5/1991 | Wullenberger et al. | 204/283 X |

FOREIGN PATENT DOCUMENTS 3815266 11/1989 Fed. Rep. of Germany .

*Primary Examiner*—Donald R. Valentine
*Attorney, Agent, or Firm*—Sprung Horn Kramer & Woods

[57] ABSTRACT

In an electrolyzer having bipolar cells, which are arranged in a row and consist each of two metallic partitions, spring-elastic electrodes bearing on the partitions, and a diaphragm which is disposed between the electrodes and is spaced from the electrodes by spacers, contact between the spring-elastic electrodes and the diaphragm is prevented by disposing the spacers of each cell directly opposite to each other and aligned with the spacers of the other cells.

16 Claims, 1 Drawing Sheet

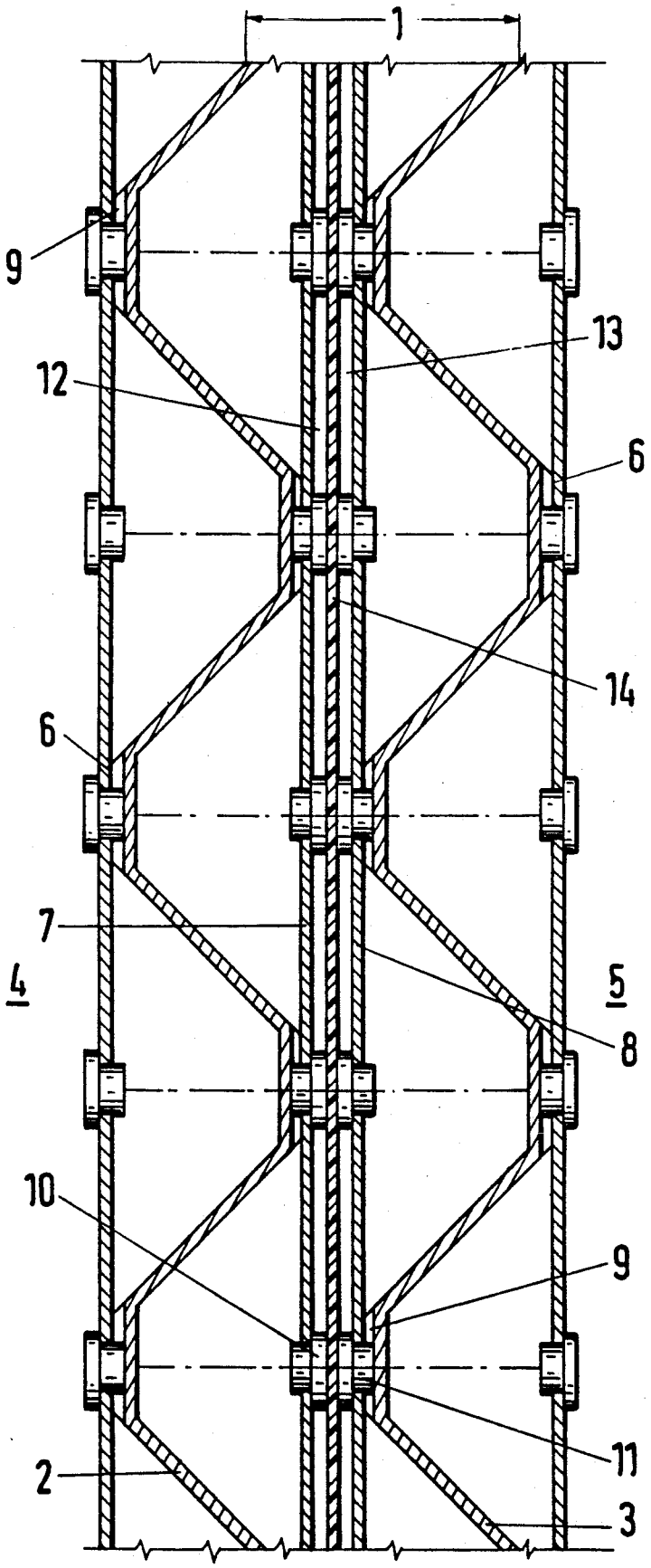
1
9
13
12
6
14
6
7
4
5
8
10
9
11
2
3

ELECTROLYZER

DESCRIPTION

This invention relates to an electrolyzer comprising bipolar cells, which are arranged in a row and consist each of metallic partitions adjoining the immediately adjacent cells, electrodes bearing on said partitions, and a diaphragm, which is disposed between the electrodes and consists of nonmetallic material and is spaced defined distances from the electrodes by spacers disposed in the cathode and anode compartments.

Such an electrolyzer has been described in DE-A-3,815,266 and allegedly provides a high safety against an occurrence of short circuits and corrosion and has a very low energy consumption. However in that electrolyzer the spacers between the diaphragm and the electrodes are disposed in the cathode and anode compartments in alternation so that inaccuracies in the manufacture of the ocmponents of the cells, e.g., of the thickness of the cell frame, or pressure differences between the cathode and anode compartments, may have the result that the clearance space may be constricted and possibly the spring-elastic electrode may contact the diaphragm in that region of the respective clearance space between the diaphragm and the cathode and the anode, respectively, which is opposite to a given spacer. The use of conventional inexpensive materials, particularly the use of steels, for making the peripheral parts of the electrolyzer, such as the gas separator, lines for circulating the electrolyte, and the like, may have the result that particularly iron, chromium, and other elements contained in steel will deposit on the cathode. In that case contact of the cathode with the diaphragm may permit iron to grow through the diaphragm as far as to the anode and to establish a short circuit there or, before the short circuit is established, may cause hydrogen to be produced in the anode region, in which oxygen is usually formed, so that the oxygen may be contaminated and this contamination may result in the local formation of an explosive gas mixture. Besides, the approach of the electrode to the diaphragm will constrict the clearance space between the electrode and the diaphragm so that rising of the gas bubbles formed on the electrode will be restricted. A slower rise will increase the amount of gas bubbles existing adjacent to the constricted portion of the clearance space so that the electrical resistance will be increased and the current density adjacent to the constricted clearance space will be decreased. Unless the electrode is adequately formed with gas outlet openings permitting an escape of the resulting gas bubbles into the clearance space between the electrode and the diaphragm, contact between the electrode and the diaphragm in such area may result in an almost total interruption of the current flow. This is not desirable because it decreases the total cross-sectional area of the gas-producing electrode surface so that the current density in the cross-section defined by the remaining gas-producing surface of the electrode and, as a result, the cell voltage and the energy loss increase. The cell temperature will rise and this may result in an overheating, which will initiate corrosion. Similar disadvantages are encountered with an electrolyzer (EP-A-0 170 051), in which the diaphragm consists of a finely porous layer, in which particles are integrated which are distributed over the surface and protrude from the surface.

It is an object of the present invention to provide an electrolyzer which is of the kind described hereinabove and in which the distance between the spring-elastic electrodes and the diaphragm will be maintained substantially constant under all conditions which are due to manufacturing inaccuracies and/or a relatively high pressure difference between the cathode and anode compartments.

That object is accomplished in that the spacers are arranged directly opposite to each other and are aligned with the spacers of the remaining cells.

The spacers are joined to the electrode and are preferably inserted in apertures or recesses of the electrode.

Alternatively, the spacers may be secured to the diaphragm and/or the diaphragm may be shaped to act as a spacer.

According to a special feature of the invention each of the cathode and anode compartments defined by the electrode and the diaphragm has a width of 0.3 to 3.0 mm, preferably of 0.5 to 3.0 mm.

The partitions which are joined to planar electrodes may serve as spacers and as current conductors and may have a regular shape in cross-section and are preferably coextensive and aligned in a row.

If the partitions are planar, the electrodes may be profiled to act as spacers.

If planar partitions and planar electrodes are used, the electrodes may bear on pinlike or barlike elements, which are joined to the partitions.

It has proved particularly desirable to provide electrodes having a thickness of 0.1 to 0.4 mm and diaphragms having a thickness of 0.2 to 1 mm.

With a view to the desired effect and to a longtime use, a diaphragm which comprises a thin nickel network as a carrying structure and layers of porous ceramic materials, such as nickel oxide, which have been sintered onto the meshwork, has proved satisfactory.

Alternatively, the diaphragm may consist of a corrosion-resisting plastic sheet.

It has been found particularly satisfactory to use electrodes which consist of a nickel substrate and a cover layer, which has been joined to the substrate on the side facing the diaphragm by cold roll-cladding a powder mixture of carbonyl nickel powder and Raney alloy powder and has been sintered and activated.

Electrodes formed with holelike apertures will not be required if, according to a special feature of the invention, the electrodes consist each of a plurality of parallel, preferably horizontal strips. A gap amounting to at least 1% of the height of the electrodes is left between the strips to permit an escape of the gas bubbles.

In a bipolar individual cell having a preferred design, the partitions consist of sheet metal elements, which have in cross-section the shape of bosses or waves or trapezoidal or triangular or rectangular corrugations and are congruent and aligned in a row.

Owing to the provision of a multiplicity of closely adjacent contact points or of contact lines between the electrodes and the partitions, the spring-elastic electrodes may be thin-walled and will nevertheless ensure that the distribution of current via the contact points between the electrodes and the partitions will involve only a small voltage drop so that the energy loss will be small. The contact may be effected in that the partitions are forced against the electrodes or by spot or seam welding.

A further feature of the invention resides in that additional spacers are joined to the electrode or the diaphragm and have a thickness which is smaller than the distance between the diaphragm and the electrodes. Even in case of extremely high pressure differences between the cathode and anode compartments such additional spacers will ensure that a sufficiently large gap is left between the electrode and the diaphragm to permit the gas bubbles to rise. During normal operation of the electrolyzer, the additional spacers joined to the electrodes or the diaphragm will not contact the diaphragm or the electrodes, respectively, so that the active surface area of one of the two components will not be decreased.

The spacers and the additional spacers in the cathode and anode compartments are desirably designed to present only small resistance to the flow of the rising mixture of electrolyte and gas bubbles and the succeeding electrolyte, so that the desirably strong rising turbulent flow will not be restricted.

This invention will be explained more in detail and by way of example with reference to the diagrammatic drawing, which is a fragmentary transverse sectional view showing the design of a bipolar individual cell.

The cell 1 consists of two partitions 2, 3, which are made of nickel-plated sheet steel and are formed with trapezoidal corrugations and clamped in an annular frame, not shown. Each partition 2 or 3 constitutes a wall which defines one of the two adjacent cells 4 and 5. The trapezoidal corrugations of the partitions 2, 3 contact the electrodes 7, 8 on small contact surfaces 6 and are formed in such surfaces with small depressions 9, which accommodate the shanks of ceramic spacers 10 and 11. The spacers 10 and 11 in the anode compartment 12 and cathode compartment 13 are disposed opposite to each other and are aligned with the spacers of the other cells 4 and 5. The diaphragm 14 is clamped between the spacers 10, 11 so that there is a defined distance between the diaphragm 14 and each of the electrodes 7 and 8.

It will be understood that the specification and examples are illustrative but not limitative of the present invention and that other embodiments within the spirit and scope of the invention will suggest themselves to those skilled in the art.

We claim:

1. An electrolyzer comprising a plurality of bipolar cells arranged in a row and each having a cathode and anode compartment, a plurality of metallic partitions respectively between adjacent cells, a plurality of electrodes respectively bearing on said partitions, a plurality of diaphragms respectively disposed between the electrodes and formed of nonmetallic material and a plurality of spacers disposed in the cathode and anode compartments to space the diaphragms defined distances from the electrodes, being the spacers (10, 11) arranged directly opposite to each other and aligned with the spacers of the other cells (4, 5).

2. An electrolyzer according to claim 1, wherein the partitions (2, 3) have a regular shape in cross-section and are congruent and aligned in a row.

3. An electrolyzer according to claim 1, wherein the partitions (2, 3) are planar, and the electrodes (7, 8) have a regular shape in cross-section and are congruent and aligned in a row.

4. An electrolyzer according to claim 1, wherein the partitions (2, 3) are planar, the electrolyzer further including pinlike or barlike elements joined to the partitions and contacted by the planar electrodes (7, 8).

5. An electrolyzer according to claim 1, wherein the spacers (10, 11) are joined to the electrode (7, 8).

6. An electrolyzer according to claim 1, wherein the clearance space (12, 13) defined between each electrode (7, 8) and its diaphragm (14) has a width of about 0.3 to 3.0 mm.

7. An electrolyzer according to claim 1, wherein each electrode (7, 8) has a thickness of about 0.1 to 0.4 mm and the diaphragm (14) has a thickness of about 0.2 to 1 mm.

8. An electrolyzer according to claim 1, wherein each diaphragm (14) comprises a thin nickel network as a carrying structure and a plurality of layers of porous ceramic material sintered onto the network.

9. An electrolyzer according to claim 1, wherein the diaphragm (14) is a corrosion-resisting plastic sheet.

10. An electrolyzer according to claim 1, wherein each electrode (7, 8) comprises a nickel substrate and a cover layer which is joined to the substrate on the side facing the diaphragm by cold roll-cladding a powder mixture of carbonyl nickel powder and Ranay alloy powder and which has been sintered and activated.

11. An electrolyzer according to claim 1, wherein each electrode (7, 8) comprises a plurality of parallel strips, a gap of at least 1% of the height of the electrode being left between two adjacent strips.

12. An electrolyer according to claim 11, wherein the strips extend horizontally.

13. An electrolyzer according to claim 1, wherein at least one of the partitions (2, 3) and the electrodes in cross-section have the shape of bosses or waves or trapezoidal or triangular or rectangular corrugations.

14. An electrolyzer according to claim 1, wherein the partitions (2, 3) and the electrodes (7, 8) are joined by spot welding or seam welding.

15. An electrolyzer according to claim 1, wherein the partitions (2, 3) and the electrodes (7, 8) are in pressure contact with each other.

16. An electrolyzer according to claim 1, including additional spacers having a thickness which is smaller than the distance between the diaphragm and each electrode, the additional spacers being joined to the electrodes (7, 8) or to the diaphragm (14).

* * * * *

UNITED STATES PATENT AND TRADEMARK OFFICE

CERTIFICATE OF CORRECTION

PATENT NO. : 5,174,878

DATED : December 29, 1992

INVENTOR(S) : Wullenweber et al.

It is certified that error appears in the above-identified patent and that said Letters Patent is hereby corrected as shown below:

Col. 3, line 57, Delete " being " and insert after " 11) "

Signed and Sealed this

Twenty-second Day of March, 1994

*Attest:*

BRUCE LEHMAN

*Attesting Officer*

*Commissioner of Patents and Trademarks*